US011352926B2

(12) United States Patent
Linzen et al.

(10) Patent No.: US 11,352,926 B2
(45) Date of Patent: Jun. 7, 2022

(54) METHOD FOR DETERMINING REGENERATION PARAMETER VALUES OF A MULTIPLE LNT CATALYST SYSTEM, AND DEVICE FOR DATA PROCESSING

(71) Applicant: Ford Global Technologies, LLC, Dearborn, MI (US)

(72) Inventors: Frank Linzen, Aachen (DE); Christoph Boerensen, Aachen (DE); Jan Harmsen, Simpelveld (NL); Christian Nederlof, Heerlen (NL); Dirk Roemer, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 121 days.

(21) Appl. No.: 16/743,659

(22) Filed: Jan. 15, 2020

(65) Prior Publication Data

US 2020/0224572 A1 Jul. 16, 2020

(30) Foreign Application Priority Data

Jan. 15, 2019 (DE) ..... 102019200367.2

(51) Int. Cl.
*F01N 3/20* (2006.01)

(52) U.S. Cl.
CPC ..... *F01N 3/2073* (2013.01); *F01N 3/20* (2013.01)

(58) Field of Classification Search
CPC ..... F01N 3/20; F01N 3/2066; F01N 3/2073; F01N 3/0885; F01N 3/0871; F01N 2900/1402; F01N 3/035; F01N 2900/1404; F01N 13/0093
See application file for complete search history.

(56) References Cited

U.S. PATENT DOCUMENTS

| | | | | |
|---|---|---|---|---|
| 8,635,855 | B2 | 1/2014 | Mital et al. | |
| 9,644,513 | B2 | 5/2017 | Lee et al. | |
| 9,765,663 | B2 | 9/2017 | Lee et al. | |
| 2004/0031261 | A1* | 2/2004 | Sun | F02D 41/0275 60/277 |
| 2004/0182068 | A1* | 9/2004 | Sun | F02D 41/0295 60/274 |
| 2007/0084195 | A1 | 4/2007 | Surnilla et al. | |
| 2007/0220864 | A1 | 9/2007 | Haugen | |
| 2008/0314022 | A1 | 12/2008 | Reuter et al. | |

(Continued)

FOREIGN PATENT DOCUMENTS

| | | | |
|---|---|---|---|
| DE | 19801625 | A1 | 7/1999 |
| DE | 10017940 | A1 | 10/2001 |

(Continued)

OTHER PUBLICATIONS

DE-102016209531-A1 English Translation (Year: 2016).*

*Primary Examiner* — Anthony Ayala Delgado
(74) *Attorney, Agent, or Firm* — Geoffrey Brumbaugh; McCoy Russell LLP

(57) ABSTRACT

Methods and systems are provided for adjusting a regeneration scheme in response to ageing of a first catalyst and a second catalyst. In one example, a method may include determining a first ageing of the first catalyst and a second ageing of the second catalyst and updating factors of the regeneration scheme based on the first ageing and the second ageing.

14 Claims, 7 Drawing Sheets

(56) References Cited

U.S. PATENT DOCUMENTS

| | | | | |
|---|---|---|---|---|
| 2015/0000255 | A1* | 1/2015 | Harmsen | F01N 13/009 60/274 |
| 2016/0201532 | A1* | 7/2016 | Chanko | F02D 41/0087 60/274 |
| 2016/0376963 | A1* | 12/2016 | Lee | F02D 41/1446 60/274 |
| 2017/0058743 | A1* | 3/2017 | Lee | B01D 53/9422 |
| 2017/0167336 | A1* | 6/2017 | Park | F01N 3/0814 |
| 2017/0314439 | A1 | 11/2017 | De Smet et al. | |
| 2019/0368402 | A1* | 12/2019 | Barrientos Betancourt | F01N 3/0842 |

FOREIGN PATENT DOCUMENTS

| | | | | |
|---|---|---|---|---|
| DE | 102007000359 | A1 | 1/2008 | |
| DE | 102012001749 | A1 | 8/2012 | |
| DE | 102011101079 | A1 | 11/2012 | |
| DE | 102016209531 | A1 * | 12/2017 | F01N 3/0814 |
| KR | 20110063140 | A | 6/2011 | |
| WO | 2009036780 | A1 | 3/2009 | |

* cited by examiner

200

| Regeneration parameter | LNT1 | LNT2 | Start/stop criterion | Typical value | Preferred value LNT1 / LNT2 |
|---|---|---|---|---|---|
| Threshold value for the nitrogen oxide load | NTh1 | NTh2 | Start | 0.1-10 g | 0.5-2g/0.2-1 g |
| Minimum LNT temperature | TMin1 | TMin2 | Start | 150-400°C | 250-350°C |
| Maximum LNT temperature | TMax1 | TMax2 | Start and stop | 400-600°C | 450-550°C |
| Nitrogen oxide fraction downstream of LNT | NBt1 | NBt2 | Start | > 50 ppm | > 100 ppm |
| λ downstream of LNT | LBt1 | LBt2 | Stop | λ < 0.98 | λ < 0.96 |
| λ target value | LSP | | - | 0.7-0.98 | 0.85-0.95 |

FIG. 2

METHOD FOR DETERMINING REGENERATION PARAMETER VALUES OF A MULTIPLE LNT CATALYST SYSTEM, AND DEVICE FOR DATA PROCESSING

CROSS REFERENCE TO RELATED APPLICATION

The present application claims priority to German patent application No. 102019200367.2, filed on Jan. 15, 2019. The entire contents of the above-listed application are hereby incorporated by reference for all purposes.

FIELD

The present description relates generally to a method for determining regeneration parameter values of a multiple LNT catalyst system.

BACKGROUND/SUMMARY

In order to reduce the emission of air pollutants, such as, for example, nitrogen oxides (NOx), and comply with legal provisions relating thereto, the exhaust gases generated by an internal combustion engine are after treated. The aftertreatment is in most cases carried out by physical-chemical means, in some cases using catalysts to influence chemical reactions.

According to a widely used method, nitrogen oxides are first intermediately stored in so-called LNT catalysts (lean NOx trap, also: NOx storage catalyst) and then periodically reduced by, for example, operating the internal combustion engine with a sub-stoichiometric, that is to say rich, fuel-air mixture a (combustion air ratio $\lambda<1$), so that the exhaust gas is enriched with species having a reducing action, such as, for example, carbon monoxide, hydrocarbons and hydrogen. Enrichment of the exhaust gas can also be carried out via an afterinjection of fuel (e.g., a post-injection), for example into a cylinder of the internal combustion engine or directly into the exhaust gas line. The reduction of the stored nitrogen oxides and release of the reaction products is also referred to as regeneration of the LNT catalyst.

Operating situations following a cold start of the internal combustion engine may have some issues and a single LNT catalyst may be insufficient in this case for storing the nitrogen oxides that are formed. Exhaust gas aftertreatment systems are therefore known which comprise two LNT catalysts arranged in series one behind the other, wherein the second LNT catalyst is arranged downstream of the first LNT catalyst stores and reduces nitrogen oxides that leak from the first LNT catalyst, that is to say the nitrogen oxide slip.

As the operating time of the LNT catalysts increases, the catalysts age, that is to say their functionality decreases, which is attributable primarily to contamination with sulfur contained in the exhaust gas and to thermal ageing due to the action of high temperatures, such as occur, for example, during regeneration of a particle filter which is likewise arranged in the exhaust gas line or on desulfurization of the catalysts, as a consequence of which the storage capacity for nitrogen oxides and oxygen falls and/or sintering or poisoning of the catalyst material can occur.

This has the result that regeneration parameters chosen initially, that is to say for an LNT catalyst in the new state, such as, for example, the frequency of the NOx regeneration, the duration of the NOx regeneration, the chosen sub-stoichiometric combustion air ratio, etc., are no longer optimal as the age of the LNT catalyst increases and may be adjusted, since otherwise sufficient regeneration and consequently sufficient removal of nitrogen oxides from the exhaust gas is no longer ensured. Another important point to consider which will be explained in detail later is that sub optimal regeneration scheduling can carry a fuel economy penalty.

If, however, two LNT catalysts arranged in series are provided, there is the additional problem that ageing of the two LNT catalysts does not take place simultaneously, that is to say each LNT catalyst has its own ageing characteristics. This is attributable to the diversity of the temperatures acting thereon and of the exhaust gases acting thereon. The first LNT catalyst ages primarily as a result of the action of high temperatures, since it is arranged close to the engine and consequently comes into contact with hotter exhaust gases than the second LNT catalyst. The main effects of this thermal ageing are a decrease in the nitrogen oxide storage capacity at low temperatures and a reduction in the NOx conversion during the regeneration.

Ageing of the second LNT catalyst arranged remote from the engine is attributable primarily to the action of sulfur which is released by the first LNT catalyst during the desulfurization thereof. This leads primarily to a decrease in the nitrogen oxide storage capacity at high temperatures.

As a result, conventional approaches for evaluating the ageing of a single LNT catalyst cannot be used for systems with two LNT catalysts because the individual ageing of the two LNT catalysts is too different, both as regards ageing overall and as regards the concrete ageing effects. That is to say, impairment of the first LNT catalyst, in particular at low and high temperatures, and impairment of the second LNT catalyst, in particular at high temperatures.

A possible solution to this problem consists in assuming the completely aged state when setting the regeneration parameters of the LNT catalysts, even when the LNT catalysts are new. In this case, sufficient removal of nitrogen oxides from the exhaust gas and compliance with statutory limit values can be ensured, because the worst possible exhaust gas aftertreatment is taken as the starting point in each case. However, this procedure causes increased fuel consumption because regeneration is carried out too often and/or for too long or a combustion air ratio during the regeneration that is not optimal for LNT catalysts in the (almost) new state is chosen. This can additionally lead to the undesirable slip of species having a reducing action.

If, on the other hand, the regeneration parameters are set for LNT catalysts in the new state or in the slightly aged state, nitrogen oxides contained in the exhaust gas are no longer removed sufficiently in the considerably aged state. In other words, the inventors of the present disclosure have recognized that disregarding the different ageing characteristics of two LNT catalysts arranged in series (dual LNT catalyst systems) leads to a loss of efficiency of such a dual LNT system.

In one example, the present disclosure comprises a method and a system configured to determine the individual state of ageing of each LNT catalyst and take it into consideration when adjusting the regeneration parameter values, that is to say the concrete numerical values of the regeneration parameters. The efficiency of the nitrogen oxide aftertreatment can thereby be increased, that is to say fewer nitrogen oxides are released into the environment. During the regeneration, the additional fuel consumption required for the regeneration can be kept low and a slip of species having a reducing action can be prevented or at least significantly reduced. In addition, the risk of oil dilution can likewise be minimized, because the number and duration of the regenerations can be reduced.

In one example, the issues described above may be at least partially solved by a method according to the disclosure for determining regeneration parameter values of a multiple LNT catalyst system having at least two LNT catalysts LNT1, LNT2, . . . , LNTn arranged in series comprises setting starting values for regeneration parameters of each LNT catalyst LNT1, LNT2, . . . , LNTn, calculating an ageing function AF1, AF2, . . . , AFn for each LNT catalyst LNT1, LNT2, . . . , LNTn and determining updated values of the regeneration parameters by applying the ageing functions AF1, AF2, . . . , AFn to the starting values of the regeneration parameters. In this way, efficient reduction and capture of $NO_x$ may be maintained.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 2 shows an overview, in table form, of exemplary regeneration parameters;

DETAILED DESCRIPTION

Figure 1:
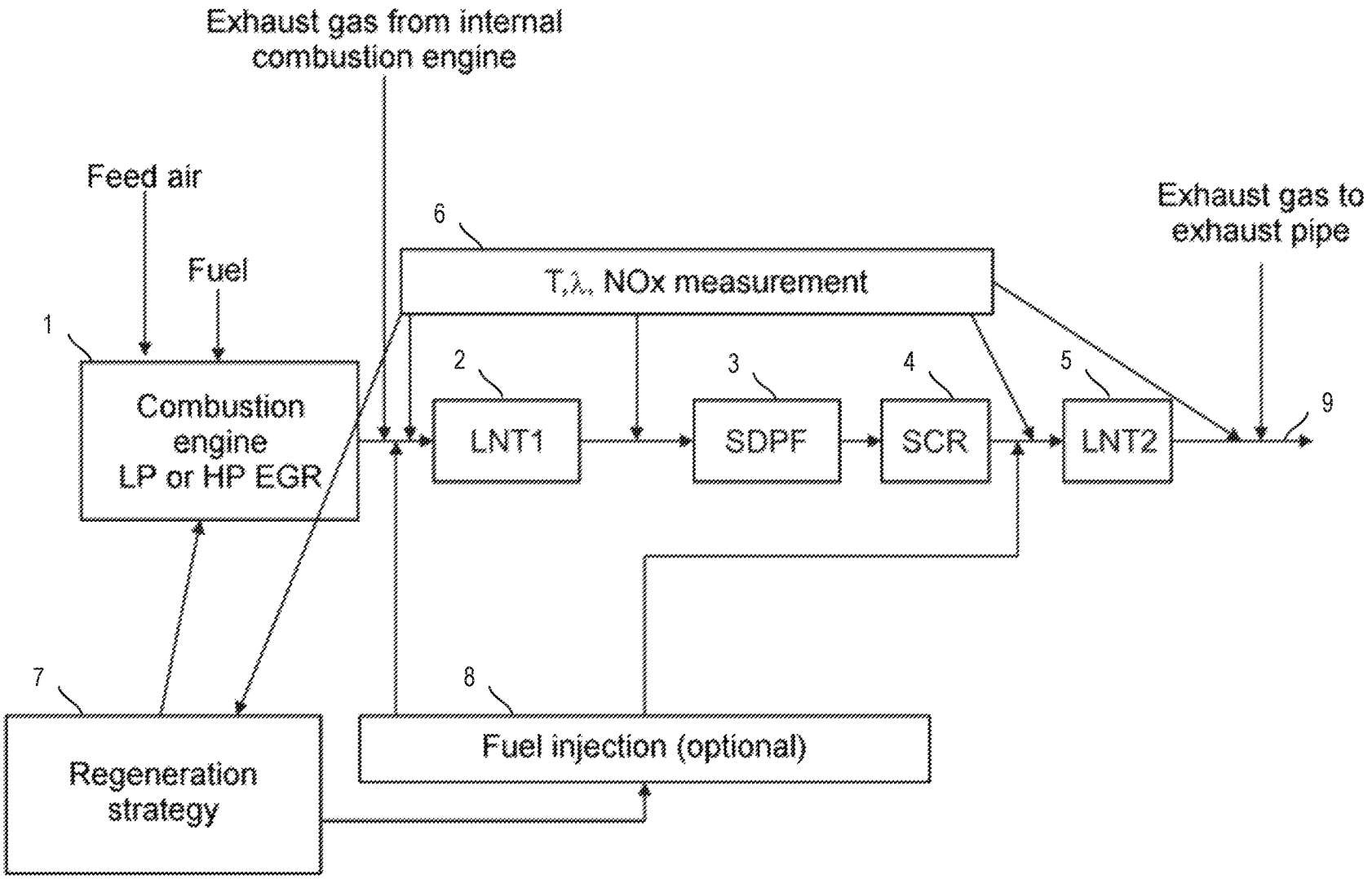
FIG. 1 shows an exemplary arrangement with a multiple LNT catalyst system.
Figure 3:
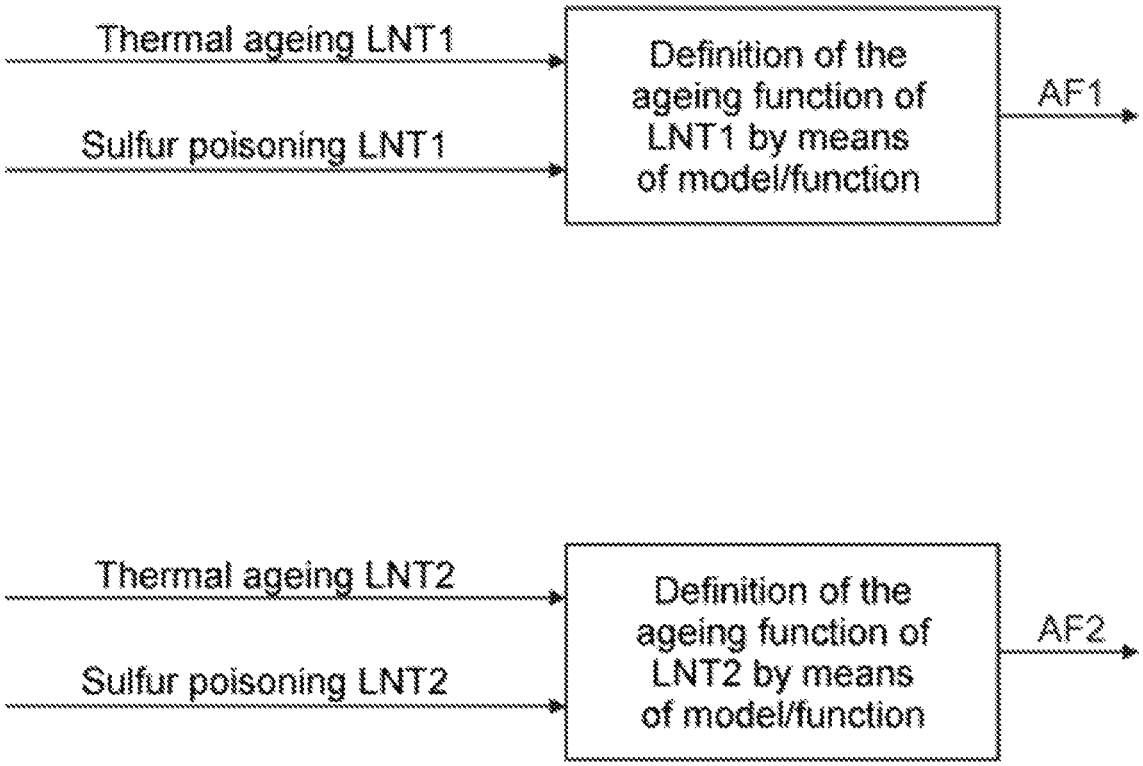
FIG. 3 shows an exemplary scheme for calculating the ageing functions.
Figure 4:
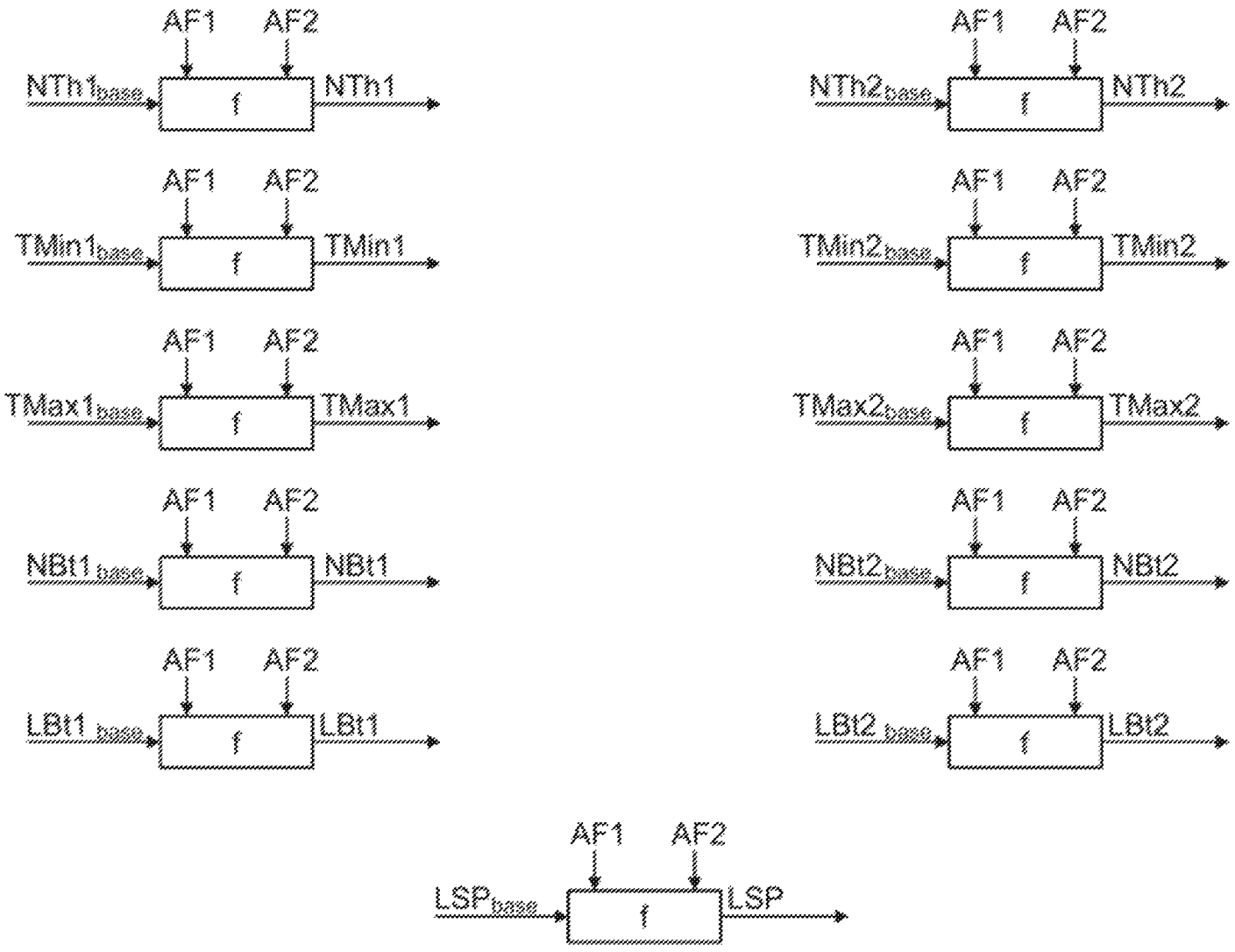
FIG. 4 shows exemplary schemes for determining updated values of the regeneration parameters.
Figure 5:
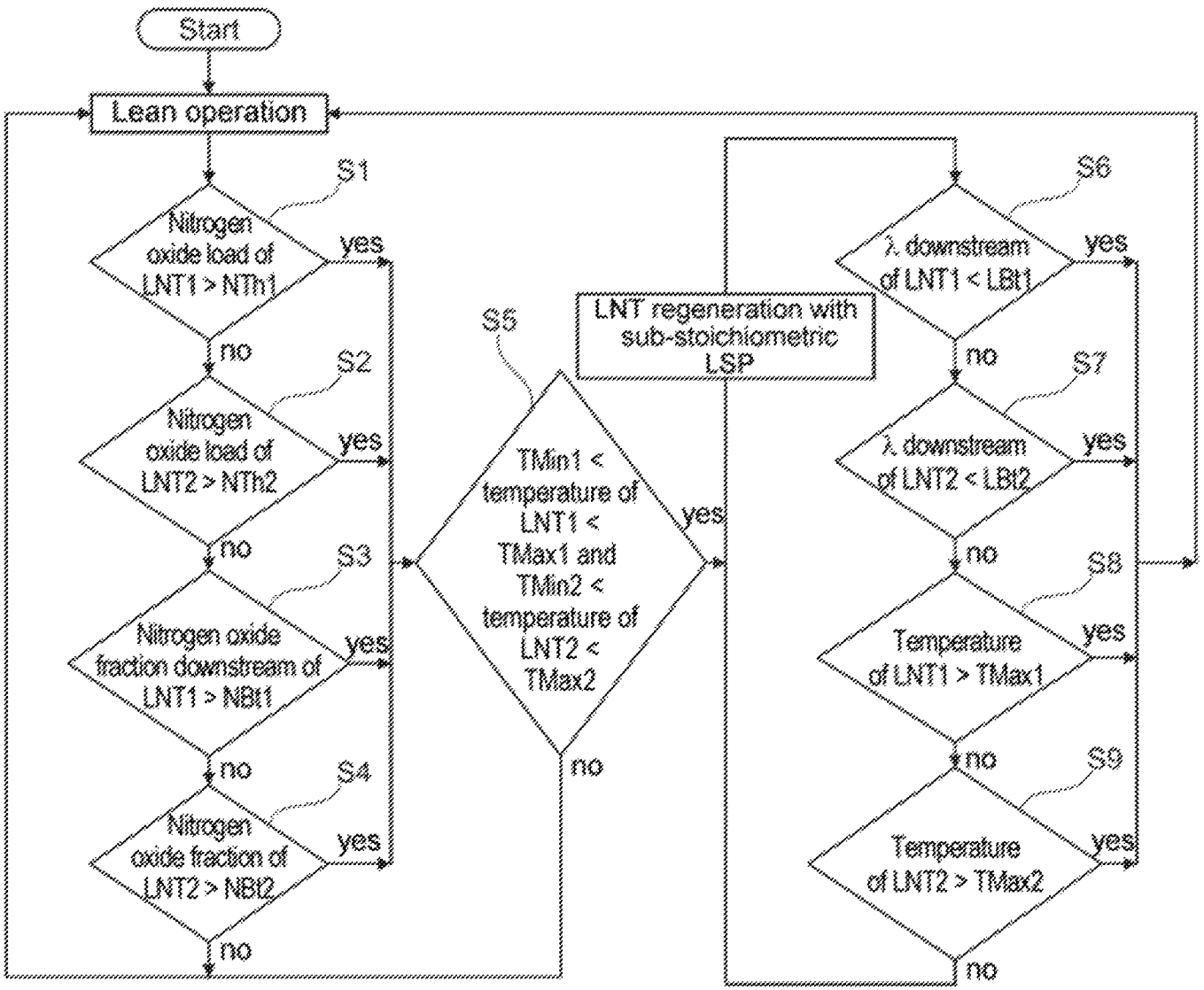
FIG. 5 shows an exemplary flow diagram of the regeneration of a multiple LNT catalyst system.
Figure 6:
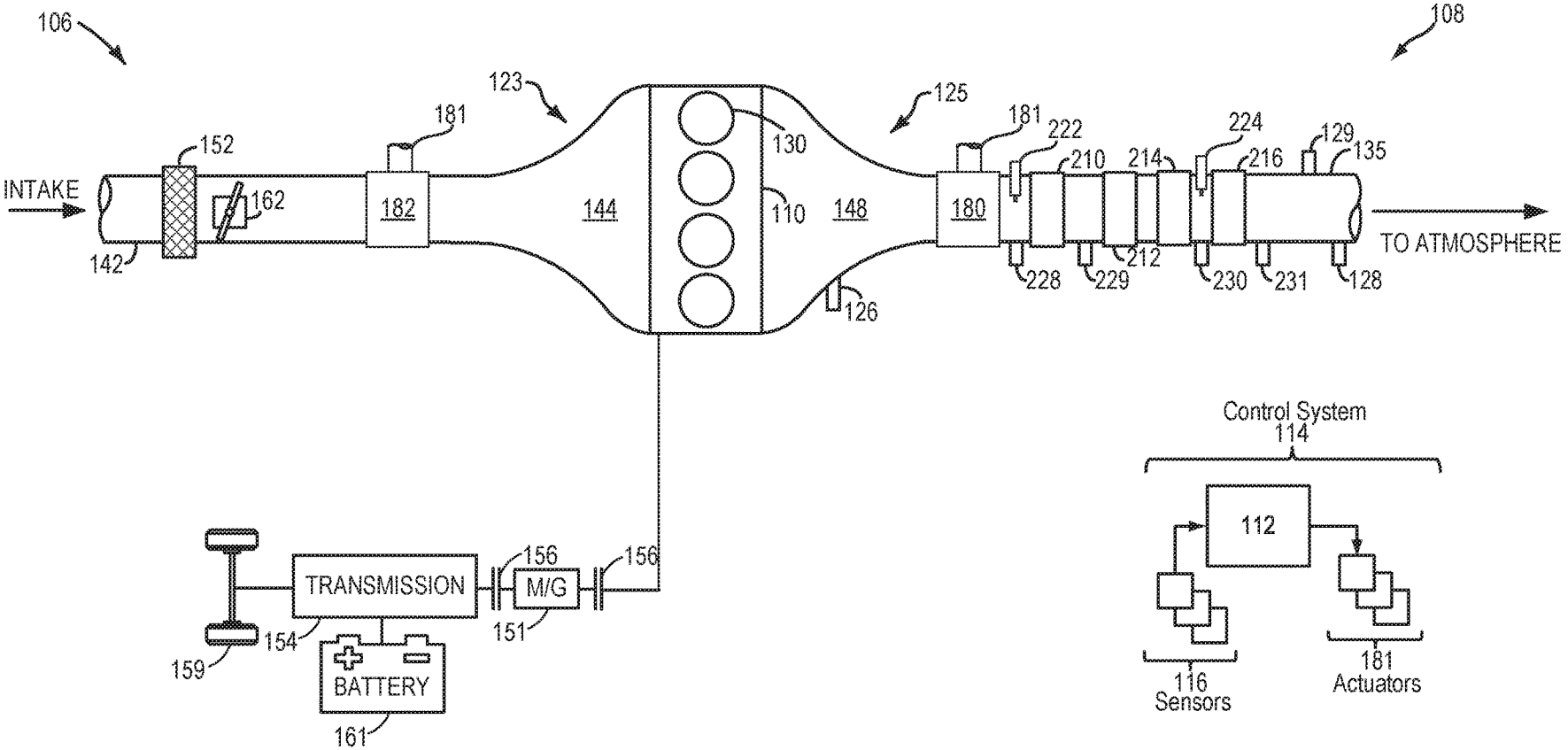
FIG. 6 shows an engine of a hybrid system comprising a plurality of aftertreatment devices arranged in series.
Figure 7:
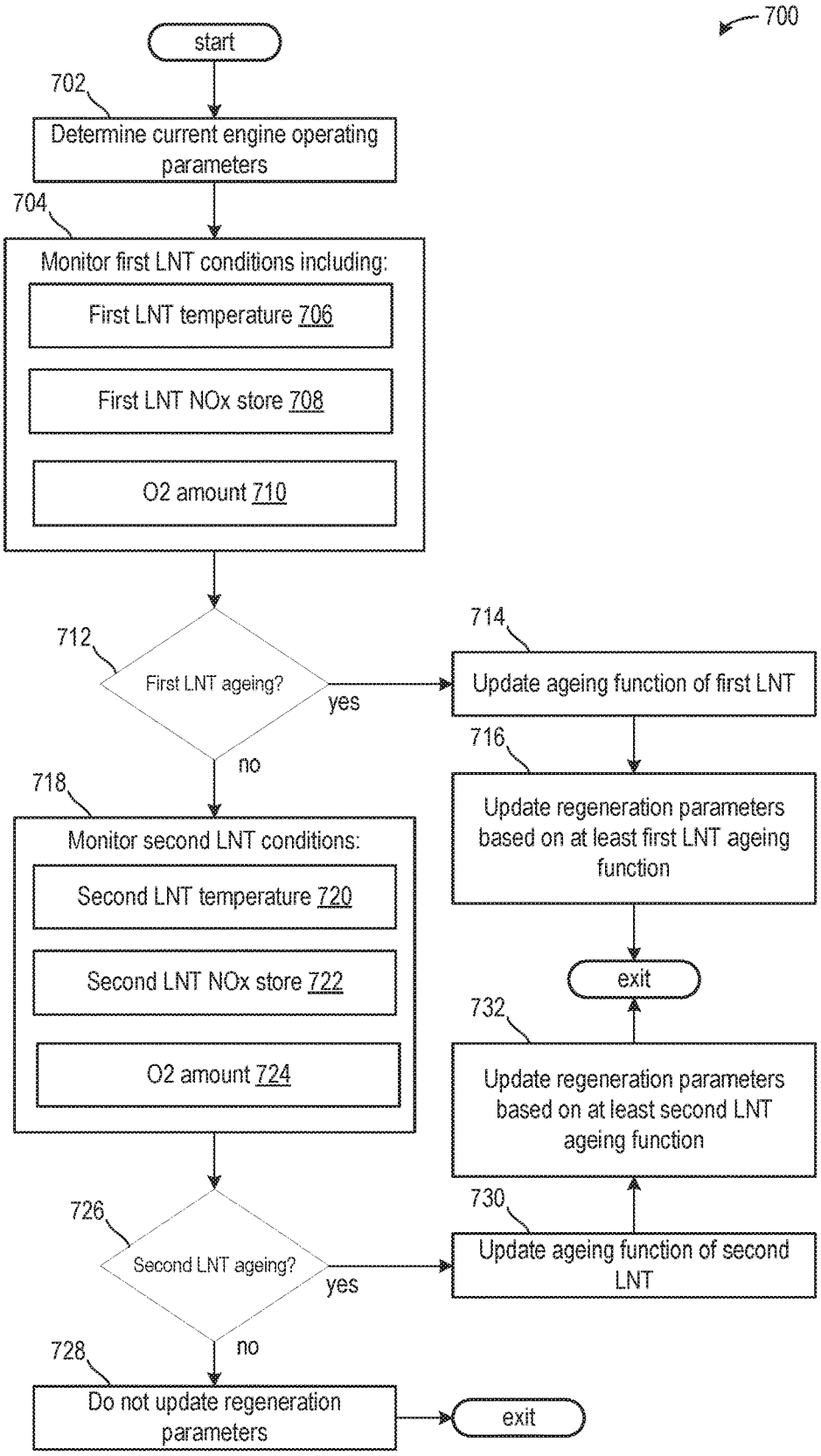
FIG. 7 shows a method for adjusting a regeneration of an aftertreatment device in response to an aging of a different aftertreatment device.

The following description relates to systems and methods for accounting for ageing during regeneration of a catalyst or treatment of exhaust gases through the catalysts. FIG. 1 shows an exemplary arrangement with a multiple LNT catalyst system. FIG. 2 shows an overview, in table form, of exemplary regeneration parameters. FIG. 3 shows an exemplary scheme for calculating the ageing functions. FIG. 4 shows exemplary schemes for determining updated values of the regeneration parameters. FIG. 5 shows an exemplary flow diagram of the regeneration of a multiple LNT catalyst system. FIG. 6 shows an engine of a hybrid system comprising a plurality of aftertreatment devices arranged in series. FIG. 7 shows a method for adjusting a regeneration of an aftertreatment device in response to an aging of a different aftertreatment device.

A multiple LNT catalyst system is to be understood as being an arrangement which comprises two or more LNT catalysts which—relative to the direction of flow of the exhaust gas from the internal combustion engine in the direction towards the exhaust pipe—are arranged or can be arranged in series one behind the other in the exhaust gas line of an internal combustion engine and through which the exhaust gas consequently flows in succession. The first LNT catalyst denoted LNT1 is arranged close to the engine and is the first of the LNT catalysts through which the exhaust gas flows. All the further LNT catalysts are arranged downstream in the order of their numbering. The multiple LNT catalyst system can be in the form of, for example, a dual LNT catalyst system having a first LNT catalyst LNT1 and a second LNT catalyst LNT2.

Regeneration is in the present case to be understood as meaning regeneration by means of the action of species having a reducing action on the nitrogen oxides stored in the LNT catalysts.

In a first method step, starting values of the regeneration parameters, that is to say regeneration parameter values with which the regeneration is initially carried out, are set for each LNT catalyst LNT1, LNT2, . . . , LNTn.

The regeneration parameters can be one or more parameters, that is to say quantities to be specified, which have been or are selected from a group comprising threshold value for the nitrogen oxide load, minimum LNT temperature, maximum LNT temperature, nitrogen oxide fraction downstream of the LNT catalyst, combustion air ratio downstream of the LNT catalyst as stop criteria for the regeneration and target value of the combustion air ratio. The values of the regeneration parameters can be set to be different for each LNT catalyst, the same for groups of LNT catalysts or the same for all the LNT catalysts. Preferably, different values are set or determined for all the regeneration parameters. An exception is the target value of the combustion air ratio (lambda set-point) during the regeneration, which can be set or determined to be the same for all the LNT catalysts, unless an additional fuel and/or air supply for the downstream LNT catalysts is provided, so that the combustion air ratio $\lambda$ can be controlled or regulated for all the LNT catalysts independently of one another.

The regeneration parameters serve to regulate the regeneration of the multiple LNT catalyst system, that is to say, for example, as start and/or stop criteria, and are changed according to the invention during the lifetime of the multiple LNT catalyst system in dependence on the state of ageing of the individual LNT catalysts, that is to say adjusted to the state of ageing. For example, starting values can be set for all the mentioned regeneration parameters in the first method step, and updated values for all the regeneration parameters can be determined by means of the method.

In a further method step, an ageing function AF1, AF2, . . . , AFn is for each LNT catalyst of the multiple LNT catalyst system. For example, it is possible for this purpose to determine the composition of the exhaust gas upstream and downstream of the LNT catalysts LNT1, LNT2, . . . , LNTn via sensors such as lambda probes and/or nitrogen oxide sensors and to calculate the storage capacity therefrom. The ageing functions AF1, AF2, . . . , AFn can take into consideration thermal ageing and/or sulfur poisoning.

The ageing functions AF1, AF2, . . . , AFn can be represented, for example, as (complex) models or as simple curves. The ageing functions AF1, AF2, . . . , AFn can be modified periodically or continuously, that is to say online models or real-time models, also based on measured values, can be prepared and used. When calculating the ageing functions, desulfurization processes and their effect on the ageing of the LNT catalysts can also be taken into consideration.

In a further method step, updated values of the regeneration parameters are determined by applying the previously calculated ageing functions AF1, AF2, . . . , AFn to the starting values of the regeneration parameters. In other words, the regeneration strategy is modified in dependence on the ageing of the LNT catalysts LNT1, LNT2, . . . , LNTn, wherein this modification can also take place periodically or continuously.

The updated values of the regeneration parameters can preferably be so determined that, in the case of high conversion of the nitrogen oxides, that is to say low nitrogen oxide emission, the fuel consumption and/or the release of species having a reducing action into the environment are minimized.

A regeneration of the multiple LNT catalyst system can then be carried out using the determined updated values of the regeneration parameters, wherein the regeneration can be carried out more efficiently on account of the adjustment of the regeneration parameters to the state of ageing of the LNT catalysts LNT1, LNT2, . . . , LNTn and the above-mentioned disadvantages can be avoided.

For example, the mechanisms of ageing discussed herein below can be taken into consideration individually for each LNT catalyst LNT1, LNT2, . . . , LNTn.

The nitrogen oxide storage capacity of all LNT catalysts decreases with increasing ageing. Consequently, the LNT catalysts are saturated with nitrogen oxides more quickly than in the new state and nitrogen oxide slip is to be observed at an earlier point in time. In order to counteract this, regeneration is desired at shorter time intervals. The regeneration can be triggered by a specific amount of stored nitrogen oxides, when it exceeds the threshold value for the nitrogen oxide load. The amount of stored nitrogen oxides can be calculated for this purpose via a model. With increasing ageing, the threshold value for the nitrogen oxide load is lowered, so that the regeneration is triggered at a lower amount of stored nitrogen oxides.

With increasing ageing of the LNT catalyst, its ability to use species having a reducing action, that is to say, for example, hydrocarbons, carbon monoxide, urea, and/or hydrogen, during the regeneration to reduce the nitrogen oxides decreases. This is caused, for example, by sintering of the catalyst material inside the LNT catalyst. Consequently, there is premature and increased slip of the species having a reducing action from an upstream LNT catalyst, that is to say, for example, the first LNT catalyst LNT1, in the direction towards a downstream LNT catalyst, that is to say, for example, the second LNT catalyst. As a result, the duration of the regeneration can be shortened with increasing ageing, since the downstream LNT catalysts each use the slip, which begins at an earlier point in time, of species having a reducing action from the upstream LNT catalysts for reducing the nitrogen oxides.

A further possibility for counteracting the slip of species having a reducing action, instead of shortening the regeneration time, consists in lowering the target value for the combustion air ratio during the regeneration. This increases the amount of species having a reducing action per unit time. Within the scope of the method according to the disclosure it is possible to determine which measure is best suited in respect of the nitrogen oxide conversion, the slip of species having a reducing action and the fuel consumption, and the updated values of the regeneration parameters can be determined accordingly.

Since the slip of species having a reducing action from an upstream LNT catalyst is used for the regeneration of the downstream LNT catalyst or catalysts, the values of the regeneration parameters should be so determined that the slip only takes place if the upstream catalysts are warm enough, that is to say their minimum LNT temperature has been reached. However, with increasing ageing, the minimum LNT temperature increases, that is to say the corresponding LNT catalyst may be heated to a higher temperature for its regeneration. Correspondingly, the value for the minimum LNT temperature, in particular for the downstream LNT catalysts, may be increased with increasing ageing. As long as the minimum LNT temperature of the downstream LNT catalysts is not reached, the regeneration should be carried out as quickly as possible and/or with a small amount of species having a reducing action, in order to minimize the slip of species having a reducing action from the upstream LNT catalyst.

In summary, it is possible via the method according to the disclosure to achieve a reduction in oil dilution and in fuel consumption. In addition, the emission of hydrocarbons and carbon monoxide can be minimized and the conversion of the nitrogen oxides can be maintained at the original level despite ageing. The invention thus permits optimized regeneration of a multiple series configured LNT catalyst system over the entire utilization period despite differing ageing of the LNT catalysts.

According to different embodiment variants, updated values of the regeneration parameters can be determined repeatedly or continuously by repeating the steps of the method, wherein the updated values of the regeneration parameters of the preceding determination step are used as the starting values of the regeneration parameters of the current determination step.

Continuous adjustment of the values of the regeneration parameters to the current state of ageing of the LNT catalysts can thereby advantageously take place, so that the above-mentioned advantages are even more pronounced. In one example, as the downstream LNT increases in ageing, regeneration parameters may be continuously updated, wherein the updates include increasing a regeneration temperature of the second LNT, decreasing a regeneration duration of the second LNT, and decreasing an amount of reductant provided to the second LNT.

According to further embodiment variants, the starting values of the regeneration parameters can be set on the basis of criteria from a group comprising properties of the catalyst material, LNT temperature for describing the regeneration ability of the individual LNTs and the ability for nitrogen oxide storage and nitrogen oxide mass flow in the exhaust gas.

A device for data processing according to the disclosure comprises elements for carrying out one of the methods described above. Consequently, the advantages of the device according to the disclosure correspond to those of the method according to the disclosure and its embodiment variants.

A computer program product according to the disclosure comprises commands which, when the program is executed by a computer, cause the computer to carry out one of the methods described above. Consequently, the advantages of the computer program product according to the disclosure correspond to those of the method according to the disclosure and its embodiment variants.

In other words, the disclosure further provides a computer program product with program code for carrying out the method according to the disclosure, when the program code is loaded into a computer and/or executed in a computer. A computer program product is to be understood as being a program code which is stored on a suitable medium and/or can be retrieved via a suitable medium.

The computer program product mentioned above is stored on a computer-readable data carrier according to the disclosure. Consequently, the advantages of the computer-readable data carrier according to the disclosure correspond to those of the computer program product according to the disclosure.

For storing the program code there can be used any medium suitable for storing software, for example a non-volatile memory installed in a control device, a DVD, a USB stick, a flashcard or the like. The program code can be retrieved, for example, via the internet or an intranet or via another suitable wireless or wired network.

Said another way, a controller comprises computer-readable instructions stored on non-transitory thereof that when executed enable the controller to adjust regeneration parameters of two or more aftertreatment devices based on an ageing one or more aftertreatment devices.

FIG. 6 shows an example configuration with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

FIG. 1 shows an exemplary arrangement having a dual LNT catalyst system which comprises two LNT catalysts LNT1 (e.g., a first LNT catalyst 2), LNT2 (e.g., a second LNT catalyst 5) and can be implemented for the method according to the disclosure. The dual LNT catalyst system is arranged in the exhaust gas line of an internal combustion engine, which can be in the form of a diesel engine, for example, and can optionally have low-pressure (LP) or high-pressure (HP) exhaust gas recirculation (EGR), Selective Catalyst Reduction (SCR) 4, and SCR coated Diesel Particular Filter (SDPF) 3. Feed air and fuel are supplied to the internal combustion engine 1, wherein the combustion air ratio λ in the normal operating state is greater than 1, that is to say the internal combustion engine is operated with a lean fuel-air mixture. In the example shown in FIG. 1, the SDPF is upstream of the SCR relative to a direction of exhaust gas flow. However, in other examples, the SCR may be upstream of the SDPF without departing from the scope of the present disclosure.

As a result of combustion of the fuel, the internal combustion engine forms an exhaust gas, which is introduced into an exhaust gas line 9. In the exhaust gas line, a plurality of exhaust gas aftertreatment devices are arranged in series one behind the other. In the exemplary embodiment, these devices are a first LNT catalyst LNT1, a particle filter with a coating for selective catalytic reduction SDPF, an SCR catalyst for selective catalytic reduction, and a second LNT catalyst LNT2. After the exhaust gas has flowed through the exhaust gas aftertreatment devices, it is guided to the exhaust pipe and released into the environment.

In the exhaust gas line there are additionally arranged a plurality of sensors 6 in order to allow the temperature, the combustion air ratio λ and the nitrogen oxide fraction in the exhaust gas to be determined upstream and downstream of the two LNT catalysts LNT1, LNT2. Optionally, a device for fuel injection 8 can be arranged upstream of each of the two LNT catalysts LNT1, LNT2, via which device the combustion air ratio λ supplied to the respective LNT catalyst LNT1, LNT2 can be adjusted.

As described at the beginning, regeneration of the LNT catalysts is demanded from time to time, for which purpose the internal combustion engine is operated for a short time with a sub-stoichiometric, rich combustion air ratio λ that is to say with $\lambda<1$, so that species having a reducing action are supplied to the LNT catalysts LNT1, LNT2. The specific point in time and the duration of the regeneration, as well as the specific combustion air ratio λ to be used, are set within the scope of the regeneration strategy 7.

Within the scope of the regeneration strategy, values for regeneration parameters are set, the regeneration being started or stopped when those values are achieved, exceeded or not met. Examples of regeneration parameters and their values are listed in the table 200 of FIG. 2. It will be seen from the table of FIG. 2, for example, that a minimum temperature Tmin1, Tmin2 must be achieved for the start of a regeneration. That temperature Tmin1, Tmin2 is typically in the range between 150–400° C., preferably between 250-350° C.

The table additionally shows that, from a nitrogen oxide fraction downstream of the respective LNT NBt1, NBt2 of >50 ppm, preferably >100 ppm, the regeneration should be started, since the nitrogen oxide storage capacity has been used up. That is to say, NBt1 represents a nitrogen oxide fraction downstream of the LNT 1 of FIG. 1 and NBt2 represents a nitrogen oxide fraction downstream of the LNT 2 of FIG. 1.

The table illustrates further regeneration parameters, including a starting NOx load storage value, a lambda value downstream of the LNT (e.g., LNT1 or LNT2). As will be described below, one or more of these parameters may be adjusted based on an ageing of the LNT1 or LNT2.

Since the LNT catalysts LNT1, LNT2 are subjected to ageing, however, the values of the regeneration parameters are changed according to the disclosure over the lifetime of the catalyst system, that is to say adjusted to the state of ageing. To that end, a separate ageing function AF1, AF2 is calculated for each of the two LNT catalysts LNT1, LNT2, respectively, as shown in FIG. 3, which ageing function can be based, for example, on a model. When calculating the ageing functions AF1, AF2, both thermal ageing and sulfur poisoning or another ageing effect can be taken into consideration.

In a further method step, the values of the regeneration parameters are updated. To that end, the ageing functions AF1, AF2 are applied to the starting values of the regeneration parameters (index "base"), as shown in FIG. 4, and updated values of the regeneration parameters are determined.

As shown, a base threshold value for the nitrogen oxide load (e.g., $NTh1_{base}$) for the initiation of regeneration of the LNT1 is updated to NTh1 based on the AF1 and AF2 functions. The minimum LNT regeneration temperature (e.g., $TMin1_{base}$) for a lowest regeneration temperature of the LNT1 is updated to TMin1 based on the AF1 and AF2 functions. The maximum LNT regeneration temperature (e.g., $TMax1_{base}$) for a highest regeneration temperature of the LNT1 is updated to TMax1 based on the AF1 and AF2 functions. A nitrogen oxide fraction downstream (e.g., $NBt1_{base}$) of the LNT1 for initiating regeneration of the LNT1 is updated to NBt1 based on the AF1 and AF2 functions. A combustion air ratio λ downstream (e.g., $LBt1_{base}$) for an upper limit during LNT1 regeneration is updated to LBt1 based on the AF1 and AF2.

Additionally or alternatively, a base threshold value for the nitrogen oxide load (e.g., $NTh2_{base}$) for the initiation of regeneration of the LNT2 is updated to NTh2 based on the AF1 and AF2 functions. The minimum LNT regeneration temperature (e.g., $TMin2_{base}$) for a lowest regeneration temperature of the LNT2 is updated to TMin2 based on the AF1 and AF2 functions. The maximum LNT regeneration temperature (e.g., $TMax2_{base}$) for a highest regeneration temperature of the LNT2 is updated to TMax2 based on the AF1 and AF2 functions. A nitrogen oxide fraction downstream (e.g., $NBt2_{base}$) of the LNT2 for initiating regeneration of the LNT2 is updated to NBt2 based on the AF1 and AF2 functions. A combustion air ratio λ downstream (e.g., $LBt2_{base}$) for an upper limit during LNT2 regeneration is updated to LBt2 based on the AF1 and AF2 functions.

Furthermore, a target value of combustion air ratio λ (e.g., $LSP_{base}$) during the regeneration of the LNT1 and/or LNT2 is updated to LSP based on the AF1 and AF2 functions. In this way, these updates may affect the regeneration timing, frequency, and amount of reductant used for each of the LNT1 and LNT2. By doing this, regeneration of the LNT1 and LNT2 may be adjusted in response to both its own ageing of the other LNT.

With the updated values of the regeneration parameters, regeneration of the two LNT catalysts LNT1, LNT2 can then be carried out, for example according to the flow diagram shown in FIG. 5 and explained herein below.

Starting from lean operation of the internal combustion engine, it is checked in a first step S1 whether the nitrogen oxide load of the first LNT catalyst LNT1 exceeds the value of the parameter NTh1, that is to say whether nitrogen oxide load LNT1>NTh1 applies. If that is the case, thus sufficient nitrogen oxides can no longer be stored in the first LNT catalyst LNT1, the method continues to step S5, described below.

If that is not the case, it is checked in step S2 whether the nitrogen oxide load of the second LNT catalyst LNT2 exceeds the value of the parameter NTh2, that is to say whether nitrogen oxide load LNT2>NTh2 applies. If that is the case, the method continues to step S5.

If that is not the case, it is checked in step S3 whether the nitrogen oxide fraction downstream of the first LNT catalyst LNT1 exceeds the value of the parameter NBt1, that is to say whether nitrogen oxide fraction downstream of LNT1>NBt1 applies. If that is the case, thus there is too much nitrogen oxide slip at the first catalyst LNT1, the method continues to step S5.

If that is not the case, it is checked in step S4 whether the nitrogen oxide fraction downstream of the second LNT catalyst LNT2 exceeds the value of the parameter NBt2, that is to say whether nitrogen oxide fraction downstream of LNT2>NBt2 applies. If that is the case, the method continues to step S5. Otherwise, lean operation is maintained and regeneration of the first LNT and the second LNT is not executed.

In step S5, compliance with the temperature demands for regeneration of the two LNT catalysts LNT1, LNT2 is checked, that is to say whether the temperature of the two LNT catalysts LNT1, LNT2 is suitable for regeneration. Only if the temperature requirements for both LNT catalysts LNT1, LNT2 are fulfilled, that is to say TMin1<temperature of LNT1<TMax1 and TMin2<temperature of LNT2<TMax2, then operation switched to sub-stoichiometric operation with a specific target value LSP of the combustion air ratio λ for regeneration. If, on the other hand, at least one temperature requirement is not fulfilled, lean operation is maintained.

In sub-stoichiometric operation (e.g., during regeneration of the LNT1 and/or LNT2), it is checked in step S6 whether the combustion air ratio λ downstream of the first LNT catalyst LNT1 is below the value of the parameter LBt1, that is to say whether λ downstream of LNT1<LBt1 applies. If that is the case, thus there is too much slip of species having a reducing action at the first LNT catalyst LNT1, operation is switched to lean operation again. Additionally or alternatively, the air/fuel ratio may be adjusted to a leaner air/fuel ration while still being rich (e.g. sub-stoichiometric) to allow regeneration to continue. Furthermore, this may indicate an inaccurate update of the LBt1 based on one or more of the AF1 and AF2 ageing functions. As such, the AF1 and/or AF2 functions may be updated and/or recalculated. Furthermore, the LBt1 may be flagged and ignored as a parameter for regeneration of the catalysts until it is again updated.

If that is not the case, it is checked in step S7 whether the combustion air ratio λ downstream of the second LNT catalyst LNT2 is below the value of the parameter LBt2, that is to say whether λ downstream of LNT2<LBt2 applies. If that is the case, operation is switched to lean operation again.

If that is not the case, it is checked in step S8 whether the temperature of the first LNT catalyst LNT1 exceeds the maximum LNT temperature Tmax1, that is to say whether temperature of LNT1>Tmax1 applies. If that is the case, operation is switched to lean operation again.

If that is not the case, it is checked in step S9 whether the temperature of the second LNT catalyst LNT2 exceeds the maximum LNT temperature Tmax2, that is to say whether temperature of LNT2>Tmax2 applies. If that is the case, operation is switched to lean operation again. If that is not the case, rich operation is maintained.

Turning now to FIG. 6, it shows a schematic depiction of a hybrid vehicle system 106 that can derive propulsion power from engine system 108 and/or an on-board energy storage device. An energy conversion device, such as a generator, may be operated to absorb energy from vehicle motion and/or engine operation, and then convert the absorbed energy to an energy form suitable for storage by the energy storage device. Engine 110 may be used similarly to the engine 1 of FIG. 1.

Engine system 108 may include an engine 110 having a plurality of cylinders 130. Engine 110 includes an engine intake 124 and an engine exhaust 125. Engine intake 124 includes an air intake throttle 162 fluidly coupled to the engine intake manifold 144 via an intake passage 142. Air may enter intake passage 142 via air filter 152. Engine exhaust 125 includes an exhaust manifold 148 leading to an exhaust passage 135 that routes exhaust gas to the atmosphere. Engine exhaust 125 may include one or more emission control devices mounted in a close-coupled position or in a far underbody position. The one or more emission control devices may include a three-way catalyst, lean NOx trap, selective catalytic reduction (SCR) device, particulate filter, oxidation catalyst, etc. It will be appreciated that other components may be included in the engine such as a variety of valves and sensors, as further elaborated in herein. In some embodiments, wherein engine system 108 is a boosted engine system, the engine system may further include a boosting device, such as a turbocharger comprising a turbine 180, a compressor 182, and a shaft 181 mechanically coupling the turbine 180 to the compressor 182.

More specifically, the engine exhaust 125 comprises a first LNT 210, an SDPF 212, an SCR 214, and a second LNT 216 arranged in series in that order. A first reductant injector 222 is arranged upstream of the first LNT 210, wherein the first reductant injector 222 is positioned to inject a reductant directly into the exhaust passage 135. A second reductant injector 224 is arranged upstream of the second LNT 216 and downstream of the SCR 214, wherein the second reductant injector 224 is positioned to inject a reductant directly into the exhaust passage 135. In one example, the second reductant injector 224 and the first reductant injector 222 may draw reductant from a shared reservoir, wherein the reductant is fuel, urea, or another similar reductant. The exhaust passage 135 further comprises a plurality of exhaust gas sensors including a first exhaust gas sensor 228, a second exhaust gas sensor 229, a third exhaust gas sensor 230 and a fourth exhaust gas sensor 231. The first exhaust gas sensor 228 and the second exhaust gas sensor 229 may be spaced about the first LNT 210 and configured to sense one or more of a temperature, air/fuel ratio, reductant concentration, NOx, or the like. Similarly, the third exhaust gas sensor 230 and the fourth exhaust gas sensor 231 may be spaced about the second LNT 216 and configured to sense one or more of a temperature, air/fuel ratio, reductant concentration, NOx, or the like.

Vehicle system 106 may further include control system 114. Control system 114 is shown receiving information from a plurality of sensors 116 (various examples of which are described herein) and sending control signals to a plurality of actuators 181 (various examples of which are described herein). As one example, sensors 116 may include exhaust gas sensor 126 located upstream of the emission control device, temperature sensor 128, and pressure sensor 129. Other sensors such as additional pressure, temperature, air/fuel ratio, and composition sensors may be coupled to various locations in the vehicle system 106. As another example, the actuators may include the throttle 162.

Controller 112 may be configured as a conventional microcomputer including a microprocessor unit, input/output ports, read-only memory, random access memory, keep alive memory, a controller area network (CAN) bus, etc. Controller 112 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines.

In some examples, hybrid vehicle 106 comprises multiple sources of torque available to one or more vehicle wheels 159. In other examples, vehicle 106 is a conventional vehicle with only an engine, or an electric vehicle with only electric machine(s). In the example shown, vehicle 106 includes engine 110 and an electric machine 151. Electric machine 151 may be a motor or a motor/generator. A crankshaft of engine 110 and electric machine 151 may be connected via a transmission 154 to vehicle wheels 159 when one or more clutches 156 are engaged. In the depicted example, a first clutch 156 is provided between a crankshaft and the electric machine 151, and a second clutch 156 is provided between electric machine 151 and transmission 154. Controller 112 may send a signal to an actuator of each clutch 156 to engage or disengage the clutch, so as to connect or disconnect crankshaft from electric machine 151 and the components connected thereto, and/or connect or disconnect electric machine 151 from transmission 154 and the components connected thereto. Transmission 154 may be a gearbox, a planetary gear system, or another type of transmission. The powertrain may be configured in various manners including as a parallel, a series, or a series-parallel hybrid vehicle.

Electric machine 151 receives electrical power from a traction battery 161 to provide torque to vehicle wheels 159. Electric machine 151 may also be operated as a generator to provide electrical power to charge battery 161, for example during a braking operation.

In some examples, additionally or alternatively, the hybrid vehicle 106 may comprise a modem, router, or similar device enabling the controller 112 to wirelessly communicate with a server to update data stored in a database. In one example, the database may store a regeneration scheme, wherein the regeneration scheme includes one or more of a threshold nitrogen oxide load value, a lower threshold temperature, an upper threshold temperature, a nitrogen oxide fraction downstream of a lean-$NO_x$ trap, a combustion air ratio downstream of the lean-$NO_x$ trap, and a target value of the combustion air ratio. The controller may update one or more of the parameters of the regeneration scheme based on an updated estimation of one or more of the first ageing factor and the second ageing factor, as described above at FIG. 4.

Turning now to FIG. 7, it shows a method for updating the ageing functions for the first LNT and the second LNT based on one or more engine operating conditions. Instructions for carrying out method 700 may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

The method 700 beings at 702 which includes determining, estimating, and/or measuring one or more engine operating parameters. The one or more engine operating parameters may include but are not limited to a manifold pressure, a throttle position, an engine temperature, an engine speed, an EGR flow rate, and an air/fuel ratio.

The method 700 proceeds to 704, which includes monitoring first LNT conditions which include a first LNT temperature at 706, a first LNT NOx store at 708, and an $O_2$ store amount at 710. Each of the conditions may affect the first LNT ageing. For example, temperatures below a lower threshold or above an upper threshold may affect first LNT ageing. Furthermore, NOx stores on the first LNT may affect first LNT ageing based on a regeneration of the first LNT, wherein increasing $NO_x$ stores result in an increased number of regenerations and therefore increased ageing. The $O_2$ amount of the first LNT may provide an indication of ageing, wherein less $O_2$ may indicate increased ageing.

The method 700 proceeds to 712, which includes determining if the first LNT is ageing based on the first LNT conditions. If the first LNT is ageing, then the method 700 proceeds to 714, which includes updating an ageing function of the first LNT (e.g., AF1). The method 700 proceeds to 716, which includes updating regeneration parameters based on at least the first LNT ageing function. The regeneration parameters apply to each of the first LNT and second LNT such that ageing of the first LNT affects regeneration parameters of each of the first LNT and the second LNT.

If the first LNT is not ageing, then the ageing function of the first LNT is not updated and the method 700 proceeds to 718, which includes monitoring second LNT conditions including a second LNT temperature at 720, a second LNT $NO_x$ store at 722, and an $O_2$ store amount at the second LNT at 724. The second LNT may age (e.g., degrade) based on one or more of these parameters. For the second LNT, and the first LNT, sulfur may also contribute to ageing, wherein sulfur concentrations may be monitored for the second LNT. Additionally or alternatively, sulfur concentrations may be accounted for the first LNT in calculating its ageing function as described above.

The method 700 proceeds to 726, which includes determining if the second LNT is ageing. If the second LNT is not ageing, then the method 700 proceeds to 728, which includes not updating regeneration parameters of the first and second LNTs. If the second LNT is ageing, then the method 700 proceeds to 730 to update an ageing function of the second LNT (e.g., AF2).

The method 700 proceeds to 732, which includes updating regeneration parameters based on at least the second LNT ageing function. As described above, if both the first and second LNTs are ageing, then the regeneration parameters may be updated based on updated values of the ageing functions of both the first LNT and the second LNT. Conditions that may age both the first and second LNT may include higher exhaust gas temperatures, lean operating conditions resulting in increased levels of $NO_x$ and $SO_2$, and regenerations.

As an example, different geographical regions are prone to have excessive/poorly regulated sulfur content in the diesel fuel. This will result in excessive ageing of LNT1 due the thermal as well as the additional desulphurization (DeSOx) events. During the DeSOx of LNT1, resultant sulfur enters LNT2. Under conventional/prior methodology, regeneration of LNT2 would only be based upon a completely aged state, which may result in excessive regeneration events. By using the process described above, a savings in fuel as well as a prolonged LNT life will be a resultant.

In one real world example, the first LNT (e.g., LNT1) may be regenerated more often than the second LNT (e.g., LNT2) due to higher sulfur concentrations at the first LNT relative to the second LNT. As such, during a $DeSO_x$ event, reductants (e.g., fuel) may be used to reduce $SO_x$ stored on the first LNT. However, CO may be released from the first LNT toward the second LNT, wherein if a regeneration temperature of the second LNT is not met, then the CO may accelerate ageing of the second LNT. In this way, ageing of the first LNT and the second LNT is not uniform. Based on the ageing of at least the second LNT, regeneration conditions of the first LNT and the second LNT may be adjusted. For example, during a subsequent $DeSO_x$ of the first LNT, less reductant may be used or a shorter duration of $DeSO_x$ may be allowed to mitigate ageing of the second LNT. Additionally or alternatively, due to the ageing of the second LNT, a regeneration temperature of the second LNT may increase, which may result in increased fuel penalties during an active regeneration of the second LNT. In this way, the second LNT threshold regeneration temperature is a dynamic value. For example, if a second LNT threshold regeneration temperature is not met, then it may be decided that regeneration of the first LNT is more economical and regeneration of the first LNT may be executed to ensure sufficient capture of $NO_x$. That is to say, the first LNT may be regenerated, even when the first LNT does not demand a regeneration, in response to a fuel penalty of regenerating the second LNT being too high. In this way, the second LNT threshold regeneration temperature is a dynamic value. Furthermore, the regeneration of the first LNT may be altered relative to previous regenerations of the first LNT to mitigate CO flow to the second LNT. The adjustments may include reduced regeneration duration, reduced reductant flow, and the like.

In some examples, additionally or alternatively, $DeSO_x$ of the first LNT may be timed to occur in conjunction with regeneration (e.g., $NO_N$ removal) of the second LNT. Additionally or alternatively, reloading of the SCR with reductant may be timed to occur in conjunction with the $DeSO_x$ of the first LNT and/or the regeneration of the second LNT. In one example, if $DeSO_x$ of the first LNT is not demanded, but the SCR demands reductant, then it may be desired to $DeSO_x$ the first LNT and allow reductant slip therethrough to be captured by the SCR. As such, ageing of the second LNT may not be accelerated.

In this way, maintenance of a plurality of aftertreatment devices arranged in series may be continuously updated based on ageing (e.g., degradation) of both first LNT and a second LNT, wherein the first LNT is upstream of the second LNT. The updates may limit accelerated degradation that occurs in previous examples where degradation of the first and second LNTs is assumed to be uniform. The technical effect of separating an ageing estimation of the first LNT and the second LNT is to increase a longevity of the first LNT and the second LNT by modifying actions that may promote ageing. By doing this, regeneration frequency, durations, and amount of reductant used may be adjusted to promote increased longevity of the first LNT and the second LNT. This may decrease vehicle maintenance and increase customer satisfaction while also decreasing fuel consumption relative to previous examples.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

an exhaust passage comprising a plurality of aftertreatment devices including a first LNT arranged upstream of a second LNT in series; and a controller with computer-readable instructions stored on non-transitory memory thereof that when executed enable the controller to:

calculate a first ageing factor for the first LNT and a second ageing factor for the second LNT;

update a base regeneration parameter for the first LNT and the second LNT based on the first ageing factor and the second ageing factor; and adjust regeneration conditions during a future regeneration of one or more of the first LNT and the second LNT based on the updated base regeneration parameter, wherein the instructions further enable the controller to adjust a regeneration scheme stored in a database via a wireless connection, wherein the wireless connection is an internet connection.

2. The system of claim 1, wherein the first ageing factor and the second ageing factor are based on thermal ageing and sulfur concentrations.

3. The system of claim 1, wherein the base regeneration parameter is one of a nitrogen oxide load on one of the first LNT or the second LNT, a lower threshold LNT regeneration temperature of the first LNT or the second LNT, an upper threshold LNT regeneration temperature of the first LNT or the second LNT, an amount of nitrogen oxide directly downstream of the first LNT or the second LNT, an air/fuel ratio directly downstream of the first LNT or the second LNT, and a target value of the combustion air ratio.

4. The system of claim 3, wherein the lower threshold LNT regeneration temperature of the second LNT is a dynamic value, wherein the lower threshold LNT regeneration temperature increases in response to the second LNT ageing.

5. The system of claim 1, wherein the instructions further enable the controller to decrease one or more of a regeneration duration, a reductant amount, and a regeneration frequency of the first LNT in response to the second LNT ageing.

6. A system, comprising:

an exhaust passage comprising a plurality of aftertreatment devices including a first LNT arranged upstream of a second LNT in series; and a controller with computer-readable instructions stored on non-transitory memory thereof that when executed enable the controller to:

calculate a first ageing factor for the first LNT and a second ageing factor for the second LNT;

update a base regeneration parameter for the first LNT and the second LNT based on the first ageing factor and the second ageing factor; and adjust regeneration conditions during a future regeneration of one or more of the first LNT and the second LNT based on an updated base regeneration parameter, wherein the first ageing factor is adjusted in response to the first LNT being operated below a lower temperature or above a first upper temperature, and wherein the second ageing factor is increased in response to the second LNT being operated above a second upper temperature.

7. The system of claim 6, wherein the first ageing factor is further adjusted in response to an amount of sulfur stored on the first LNT, and wherein the second ageing factor is further adjusted in response to an amount of reductant directed to the second LNT when a second LNT temperature is less than a lower threshold regeneration temperature.

8. The system of claim 1, wherein a selective catalytic reduction device is arranged between the first LNT and the second LNT.

9. The system of claim 8, wherein a particulate filter is arranged between the first LNT and the second LNT.

10. The system of claim 9, wherein the particulate filter is arranged upstream of downstream of the selective catalytic reduction device.

11. An exhaust gas aftertreatment system, comprising:

an exhaust gas passage fluidly coupled to an engine, the exhaust gas passage comprising a first LNT, a particulate filter, a selective catalytic reduction device, and a second LNT, wherein the first LNT is upstream of the particulate filter, wherein the particulate filter is upstream of the selective catalytic reduction device, and wherein the selective catalytic reduction device is upstream of the second LNT relative to a direction of exhaust gas flow; and a controller comprising instructions stored on non-transitory memory thereof that when executed enable the controller to:

adjust a regeneration scheme via an internet connection based on a first ageing factor of the first LNT and a second ageing factor of the second LNT.

12. The exhaust gas aftertreatment system of claim 11, wherein the first ageing factor accounts for thermal ageing and sulfur load of the first LNT and wherein the second ageing factor accounts for thermal ageing and a reductant load of the second LNT.

13. The exhaust gas aftertreatment system of claim 11, wherein the first LNT is in a close-coupled position proximal to the engine and the second LNT is in a far-underbody position, wherein the close-coupled position comprises exhaust gas temperatures higher than exhaust gas temperatures at the far-underbody position.

14. The exhaust gas aftertreatment system of claim 11, wherein the regeneration scheme comprises one or more of a threshold nitrogen oxide load value, a lower threshold temperature, an upper threshold temperature, a nitrogen oxide fraction downstream of a lean-$NO_x$ trap, a combustion air ratio downstream of the lean-$NO_x$ trap, and a target value of the combustion air ratio.

* * * * *